US006695312B1

(12) United States Patent
Ward

(10) Patent No.: US 6,695,312 B1
(45) Date of Patent: Feb. 24, 2004

(54) METHOD OF PLAYING A WAGERING CARD GAME

(76) Inventor: Randall Ward, Route 1 Box 416 B-3, South Shore, KY (US) 41175

( * ) Notice: Subject to any disclaimer, the term of this patent is extended or adjusted under 35 U.S.C. 154(b) by 0 days.

(21) Appl. No.: 10/261,059

(22) Filed: Sep. 30, 2002

(51) Int. Cl.[7] ..... A63F 1/00

(52) U.S. Cl. ..... 273/292; 273/236; 273/274; 273/309

(58) Field of Search ..... 273/292, 236, 273/274, 309

(56) References Cited

U.S. PATENT DOCUMENTS 5,437,462 A * 8/1995 Breeding ..... 273/292
5,632,489 A * 5/1997 Rozzi et al. ..... 273/304
5,851,011 A * 12/1998 Lott ..... 273/292
6,007,424 A * 12/1999 Evers et al. ..... 463/13
6,050,569 A * 4/2000 Taylor ..... 273/292
6,220,597 B1 * 4/2001 Scibetta ..... 273/292
6,428,002 B1 * 8/2002 Baranauskas ..... 273/236
6,454,266 B1 * 9/2002 Breeding et al. ..... 273/292
6,471,207 B1 * 10/2002 Schlaifer ..... 273/138.1
6,488,281 B2 * 12/2002 Stupak ..... 273/138.1
6,517,072 B1 * 2/2003 McInerney ..... 273/236

* cited by examiner

*Primary Examiner*—Steven Wong
*Assistant Examiner*—Dolores Collins

(57) ABSTRACT

The present invention provides a wagering card game played with a standard fifty-two card deck of cards in which a dealer deals two cards to each of the players. The player must in turn choose whether to try to get one hit card that is numerically between the values of the two dealt cards or to get two hit cards that are above and below, respectively, the values of the two dealt cards. In either case, if the dealt cards constitute a pair, the player automatically loses. As dealt cards, aces are automatic loss cards and also are as hit cards unless assurance, a fee that allows an ace dealt as a hit card to be replaced by another hit card or to be put in play, depending on which option of the game the player has chosen to play, has been purchased. Under the rules of the game of the present invention, the poker hands consisting of a straight, a flush, or a straight flush are also winning hands, but hands consisting of two or three of a kind are losing hands, with one exception made in one option of the game with an assurance purchase. The players do not compete against the house and more than one hand can win each round. Players with winning hands are paid according to a predetermined pay out schedule.

21 Claims, 5 Drawing Sheets

METHOD OF PLAYING A WAGERING CARD GAME

This patent application does not contain any federally sponsored research nor does it relate to any federally research development.

BACKGROUND OF THE INVENTION

Poker is one of the most popular of all card games, and there are several different variations of the game that are well known in the art. Many of these variations were designed specifically for play at gambling casinos, with the emphasis often being upon giving players more than one opportunity to win. This is accomplished by providing multiple betting opportunities or by allowing side bets of various types. For example, a popular poker game currently being played in gambling casinos is Let It Ride, as described in U.S. Pat. No. 5,437,462. This game offers multiple betting stages and the opportunity for a possible additional jackpot.

A limitation of many of the poker games offering multiple stages of betting, or of side bets, is that they can be a bit too complex for the average casino gambler. Accordingly, casinos are always looking for new games to play that involve some skill on the part of the gambler, but at the same time are easy to play, and in which the determination of whether one has won or lost can be quickly made.

Another limitation of current poker games being played at casinos is that the rules of the game are set such that there is only one way to play, and win, the game. This can detract from the thrill of playing the game, as well as take away from the player the ability to make some potentially important strategic decisions.

Another limitation of most current poker games is that only one hand can be a winner for each round, and the players often have to play against the house as well. Therefore, there is a need for a variation of a poker game that is easy to play, in which the player has options regarding how to play the game, the allows several winning hands in one round, and the outcome of the game can be determined quickly.

BRIEF SUMMARY OF THE INVENTION

An object of the present invention is to provide a wagering card game, played with a standard deck of fifty-two playing cards, preferably a poker deck.

Another object of the present invention is to provide a wagering card game that is easy to play and will attract both seasoned card players and novice gamblers.

Yet another object of the present invention is to provide a wagering card game that offers a quick determination of winning and losing hands, so that the excitement of playing the game is always present, and many hands can be played over a period of time.

Yet another object of the present invention is to provide a wagering card game that allows for the possibility of several players winning on a single hand, thus encouraging people to play the game.

Yet another object of the present invention is to provide a wagering card game that allows players to win without having to compete directly against the house or dealer in the game.

Yet another object of the present invention is to provide a wagering card game that offers the players the ability to determine how to play the game, and the rules that will govern whether the hand wins or loses, as a strategic decision made by the player.

Yet another object of the present invention is to provide a wagering card game that is easily adaptable to being played via an electronic gaming machine, computer, or other electronic device, for single or multiple players.

All of the above listed objects of the present invention, as well as others not listed above, will become apparent from the following detailed description of the preferred embodiment of the method of playing the game, taken in conjunction with the accompanying drawing figures and descriptions thereof.

DETAILED DESCRIPTION OF THE PREFERRED EMBODIMENTS

A description of a preferred embodiment of the method of playing the card game of the present invention will now be described with reference to FIG. 1.

Figure 1:
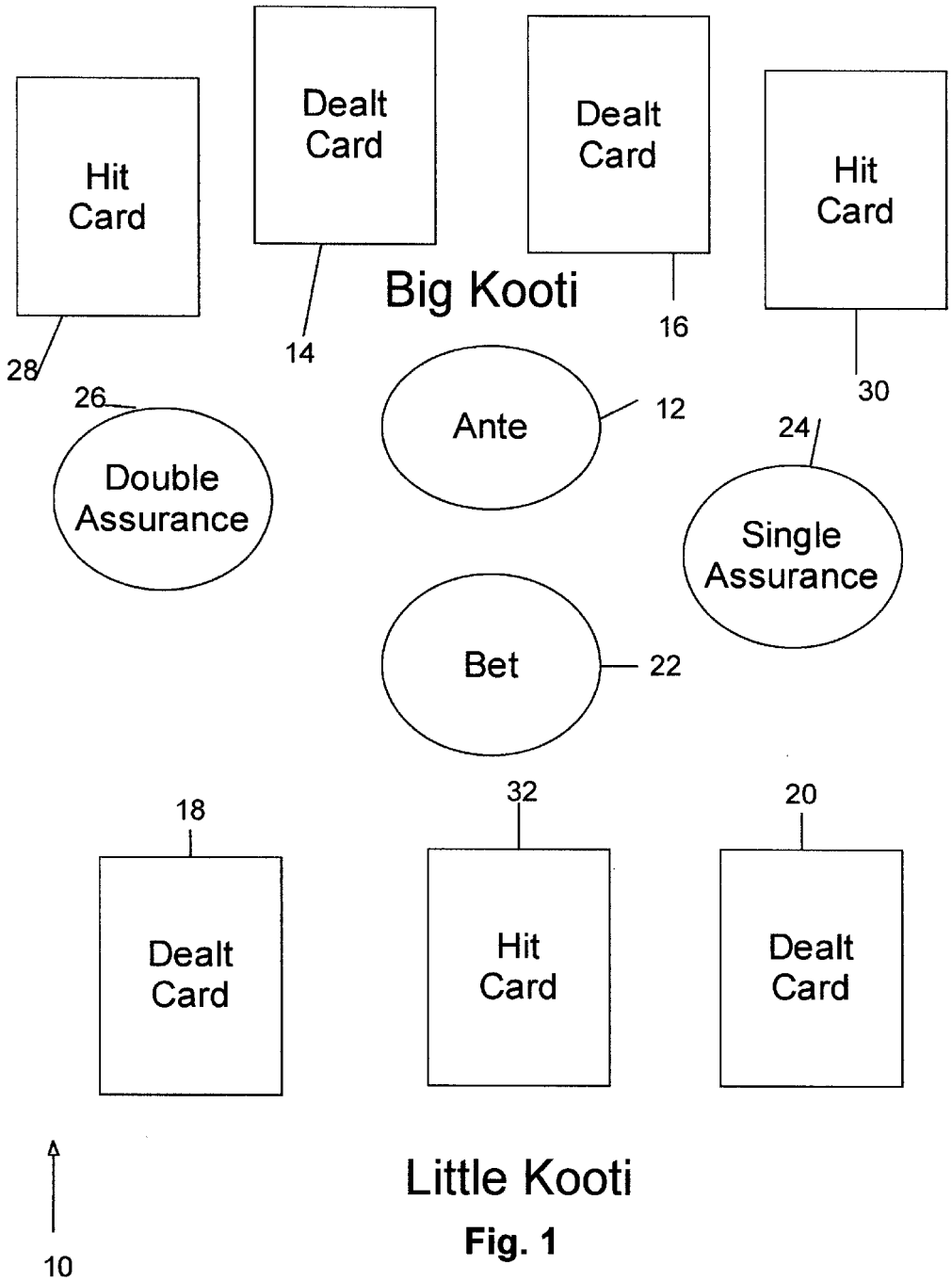
FIG. 1 shows a preferred layout of the betting area on a card table used to play the present invention.

Referring to FIG. 1, the wagering card game of the present invention, referred to herein as Kooti Poker, is a card game played on a real or simulated playing station 10. The playing station 10 is preferably a preprinted felt covering that is placed on top of a gambling table. Alternatively, the playing surface can be simulated on a video screen and the game can be played under software control with the cards being simulated and the player participating via an interactive video station. Depicted on the playing station 10 is an ante circle 12; a pair of card docks 14, 16 for receiving the cards originally dealt to the player electing to play the Big Kooti option of the present invention, as well as a pair of card docks 28, 30 for receiving the hit cards for this option; a pair of card docks 18, 20 for receiving the cards originally dealt to the player electing to play the Little Kooti option of the present invention, as well as a card dock 32 for receiving the hit card for this option; a bet circle 22 for receiving the player's wager; a first assurance dock 24 for players wanting to buy single assurance, and a second assurance dock 26 for players wanting to buy double assurance for the Big Kooti option.

Figure 2:
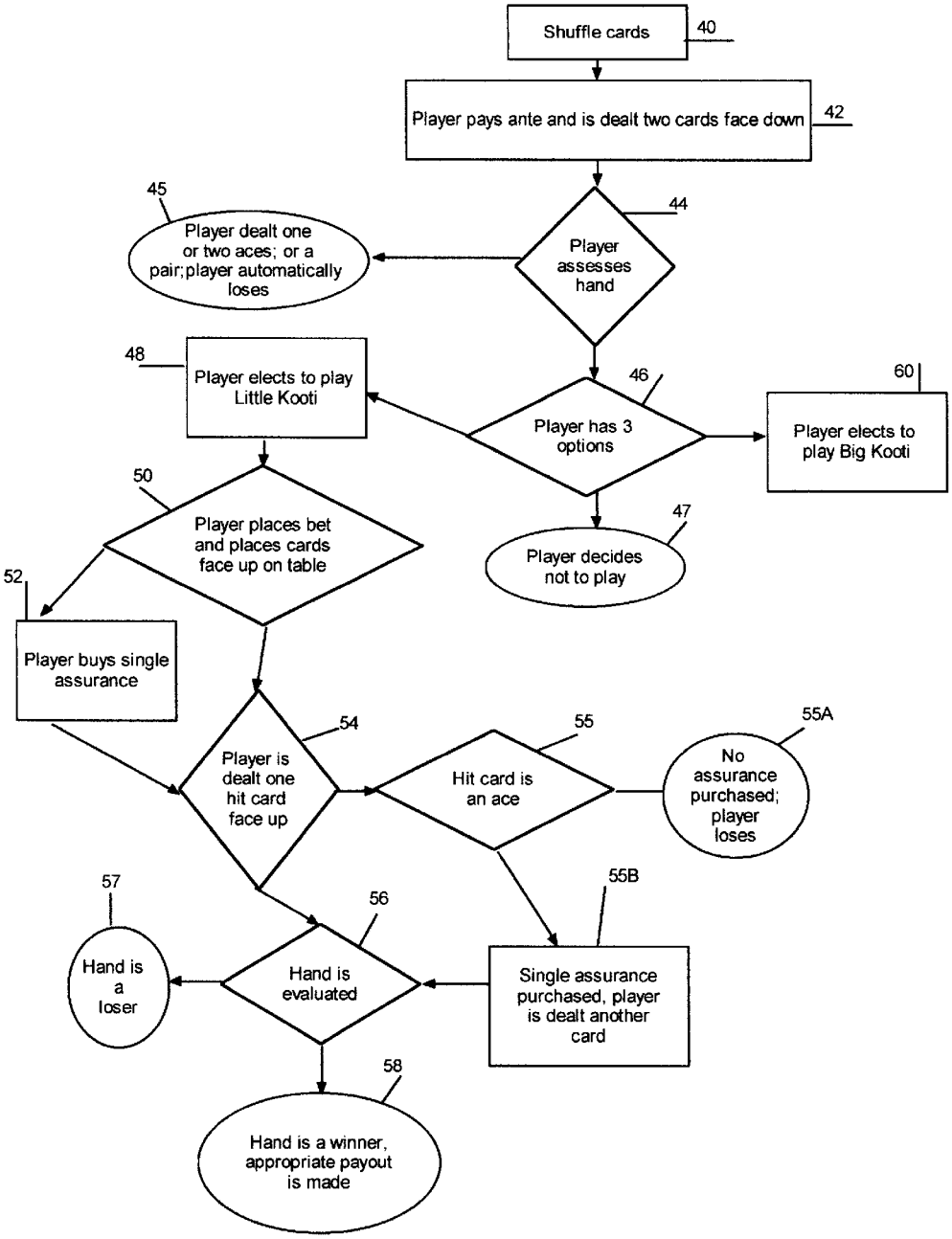
FIG. 2 shows a flow chart detailing the method of playing a first option of the present invention.
Figure 3:
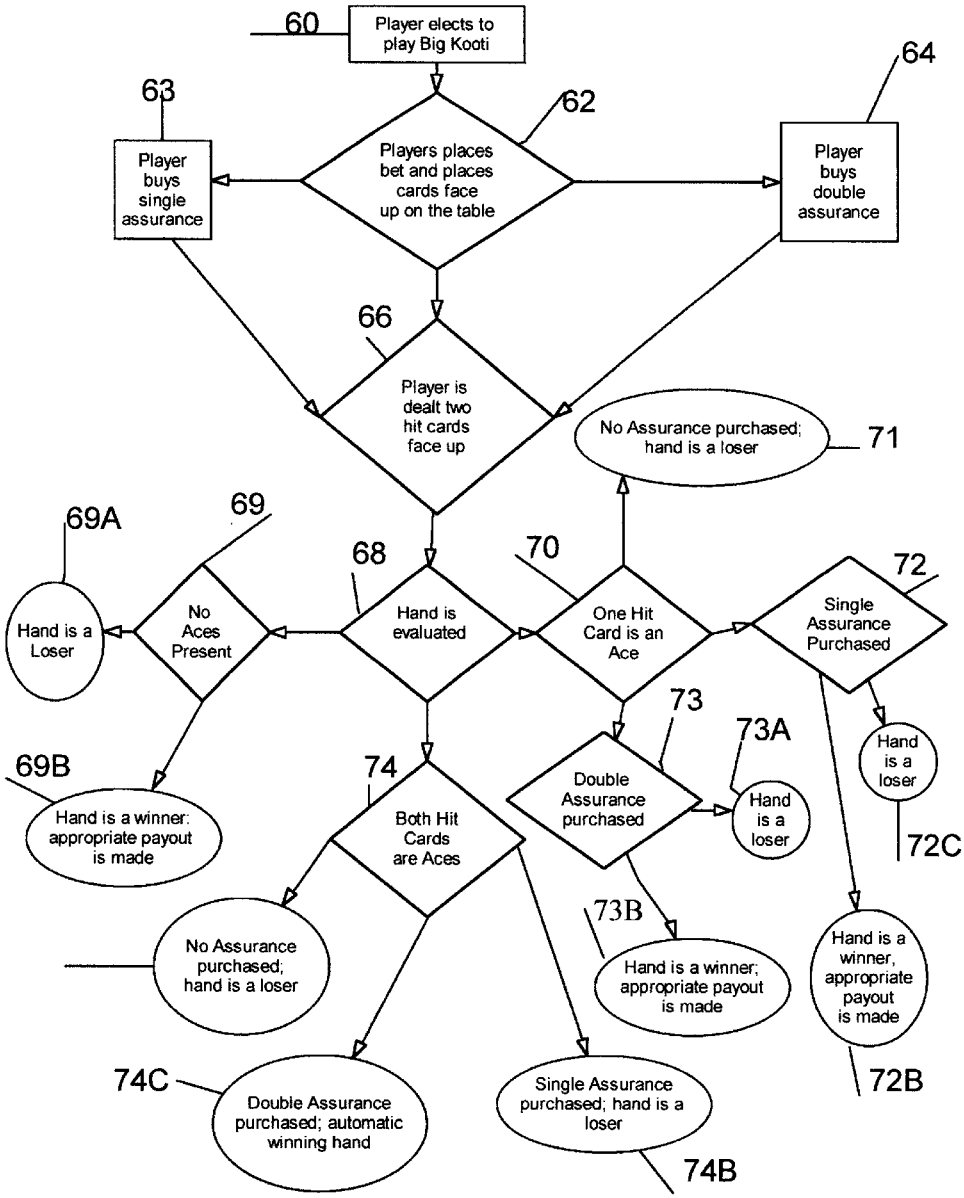
FIG. 3 shows a flow chart detailing the method of playing a second option of the present invention.

Referring now to the flow diagrams in FIG. 2 and FIG. 3, the method of playing the wagering card game of the present invention can be detailed, with references to the items described in FIG. 1. A standard deck of poker cards is shuffled at block 40. The player pays the ante at the ante circle 12 and is dealt two cards face down by the dealer at block 42. The player assesses the two cards at block 44. If one or both of the cards dealt to the player is an ace, the player automatically loses and forfeits the ante at block 45. If the player is not dealt an ace on the original deal, the player then has three options at block 46. The first option is that the player can decide not to play the game and not to bet, thereby forfeiting the ante at block 47.

The second option is to elect to play the Little Kooti version of the game at block 48. The player places a bet on the betting circle 22 and then places the two cards face up on the card docks 18, 20, with the lower numerical value card being placed at card dock 18, in block 50.

The player then has the option of purchasing single assurance on dock 24 in block 52. In Little Kooti single assurance means that if an ace is dealt as the hit card, which would otherwise make it an automatic losing hand, the ace is nullified and the player is dealt one more hit card by the dealer. After the decision is made the player is then dealt one hit card, placed face up on the hit card dock 32 between the two dealt card docks 18, 20 in block 54. If the hit card is an ace in block 55, and single assurance was purchased, the player is dealt another hit card in block 55A. If the hit card is an ace, and single assurance was not purchased, the player automatically loses in block 55B. If the hit card is not an ace, the hand is evaluated to see if it is a winning hand in block 56. If the answer is no, the player loses in block 57. If the answer is yes, the appropriate payout to the player is made in block 58.

The third option is to elect to play the Big Kooti version of the game at block 60. The player places a bet on the betting circle 22 and then places the two dealt cards face up on the card docks 14 and 16 with the lower numerical value card being placed at card dock 14, in block 62. The player then has the option of purchasing single assurance on dock 24 in block 63, or of purchasing double assurance on dock 26 in block 64. In Big Kooti single assurance means that if an ace is dealt as a hit card, which would otherwise be an automatic losing hand, the ace must be placed as a low card in dock 28. Single assurance in Big Kooti allows the first ace as a hit card to be used, but the use is restricted in that it is a low card only. The aces do not swing to the high card position. Double assurance, which is only available in Big Kooti, has two components—first, a single ace can be played high or low and placed in dock 28 or dock 30, as the player desires, or, if two aces are dealt as hit cards, one ace swings low to dock 28 and the other swings high to dock 30, which is known as a Koo-ti-ta. Note that, if only single assurance is purchased and two aces are dealt as hit cards, the player automatically loses.

The player upon playing Big Kooti receives two hit cards, placed face up outside the two dealt card docks 14, 16 on the hit card docks 28, 30 in block 66. The hand is evaluated in block 68. If no aces are present in block 69, the hand is determined to be a losing hand in block 69A or a winning hand in block 69B, and the appropriate pay out is made for the winning hand. If one ace is present in block 70, and no assurance was purchased, the hand is a losing hand in block 71. If single assurance was purchased, then the determination is made in block 72 whether the hand is a losing hand in block 72A or a winning hand in block 72B, and the appropriate pay out is made. If double assurance was purchased, the determination is made in block 73 whether the hand is a losing hand in block 73A or a winning hand in block 73B, and the appropriate pay out is made. If both hit cards are aces in block 74, and no assurance was purchased, the hand is a losing hand in block 74A; similarly, if only single assurance was purchased, the hand is a losing hand in block 74B. If double assurance was purchased, then the hand is an automatic winner, known as a Koo-ti-ta, in block 76. After each round of play the dealer collects all cards and another round is dealt, with another reshuffled deck of cards to be used for each round of play.

In Little Kooti the main object of the game is to get a hit card that falls numerically between the two dealt cards. The king is the highest card, and the deuce is the lowest, with aces being automatic loss cards. Assuming that a king and a deuce are the two cards dealt to the player, the only way the player can lose is if the hit card is a king, a deuce, or an ace. If an ace is dealt as the hit card, and single assurance has been purchased, the player is dealt one more hit card. If the next hit card is also an ace, the player automatically loses; single assurance in Little Kooti only protects against the first hit card.

In addition to having the hit card fall between the dealt cards, players may also win at Little Kooti by forming hands that constitute straights, flushes, and straight flushes. Even if the hit card is not numerically between the dealt cards, the player can still win if the three cards form a straight, a flush, or a straight flush; however, the payouts are higher if the hit card is numerically between the dealt cards. Here again, aces are automatic loss cards, even if a straight, flush, or straight flush could be formed using an ace. The poker hands of two, three, or four of a kind mean nothing in Kooti Poker games and no payouts are made for them.

Therefore when a pair is dealt on the original two card deal, the player is an automatic loser.

In Big Kooti the main object of the game is to get two hit cards that fall numerically above and below the two dealt cards. The king is the highest card, and the deuce is the lowest, with aces being automatic loss cards. Assuming that a seven and an eight are the two cards dealt to the player, the only way the player can lose is if the hit cards are a seven, an eight, or an ace; unless single or double assurance, as appropriate, has been purchased, as explained previously.

In addition to having the hit cards fall numerically above and below the dealt cards, players may also win at Big Kooti by forming hands that constitute straights, flushes, and straight flushes. Even if the hit cards are not numerically above and below the dealt cards, the player can still win if the four cards form a straight, a flush, or a straight flush; however, the payouts are higher if the hit cards are numerically above and below the dealt cards. In the case of Big Kooti, one ace may be used with an additional card with single assurance that can make a regular hand. If double assurance has been purchased any aces can be used to form straights, flushes, or straight flushes, as appropriate; otherwise, Aces are automatic loss cards, even if a straight, flush, or straight flush would otherwise be formed if there has been no assurance purchased.

Figure 4:
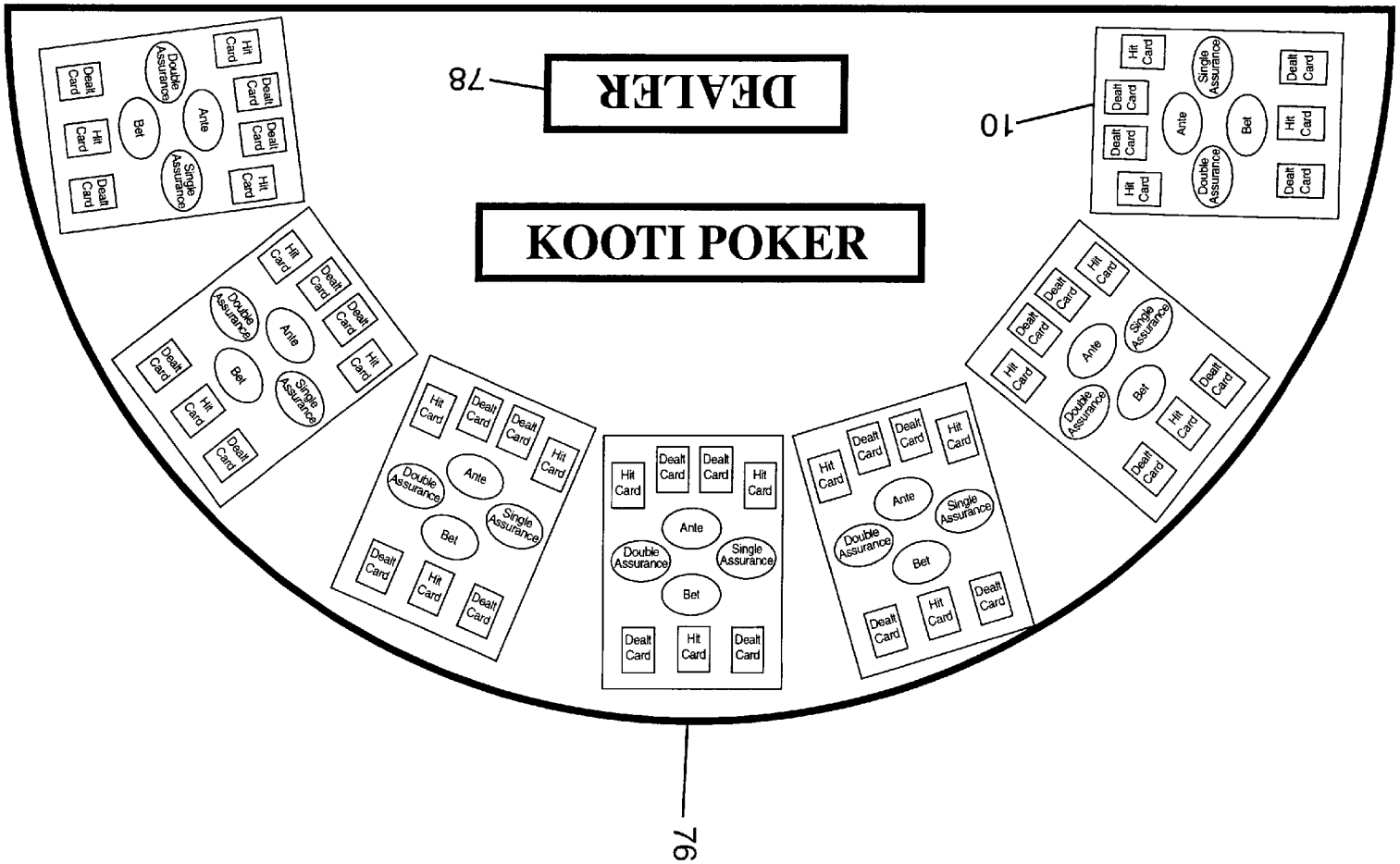
FIG. 4 shows a preferred layout of a card table used in connection with the method of playing the present invention.

Referring to FIG. 4, a table 76 with seven different player stations 10 is illustrated. This would be a suggested format for playing Kooti Poker within a gambling casino environment.

Figure 5:
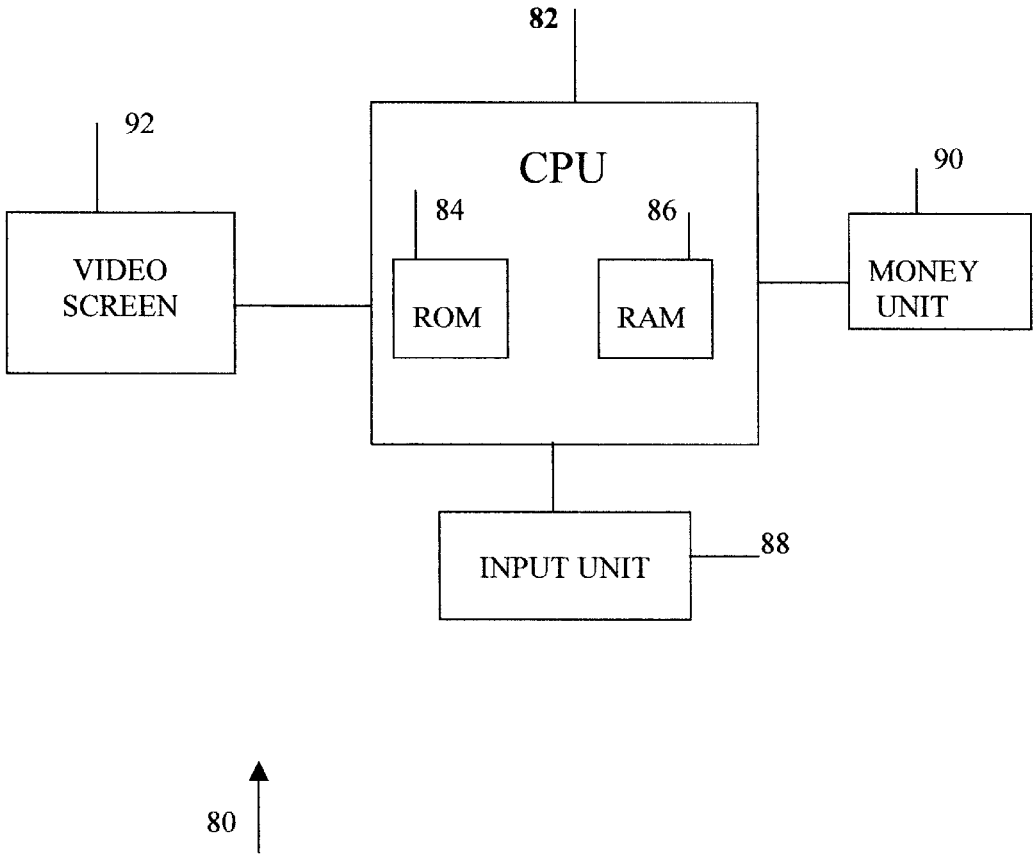
FIG. 5 shows a schematic diagram of an electronic video game for use of the method of the present invention.

Referring to FIG. 5, the method of playing the wagering card game of the present invention can be embodied by playing it through an electronic video game 80. A central processing unit (CPU) 82 controls the various components. The CPU includes a ROM 84 for storing a control program and a RAM 86 for use as a work area. The video game includes an input unit 88 where one or more players can input their bets and determine which version of the game to play. A payout unit 90 can accept and pay out coins, bills, and credit. Images of the game table and cards can be displayed on a video screen 92. Play of the game is otherwise identical to that of the above described embodiment, with the same rules and odds applying.

The betting and payout schedules for Kooti Poker may vary, depending on what limits the casino wishes to establish. These are sample payout schedules recommended for the two versions of the game, and given herein for explanation purposes only.

| Dealer/House Payout Odds On Winning Little Kooti Hands | |
|---|---|
| Little Kooti winning hand | 1–1 |
| Little Kooti flush | 3–1 |
| Little Kooti straight | 5–1 |
| Little Kooti straight flush | 20–1 |
| Regular straight | 2–1 |
| Regular flush | 2–1 |
| Regular straight flush | 3–1 |
| **Dealer/House Payout Odds On Winning Big Kooti Hands** | |
| Big Kooti winning hand | 2–1 |
| Big Kooti flush | 8–1 |
| Big Kooti straight | 8–1 |
| Big Kooti straight flush | 40–1 |
| Regular straight | 3–1 |
| Regular flush | 3–1 |
| Regular straight flush | 5–1 |

Policy on Payout Odds for Winning Hands With Assurance Purchases

A payout for a winning hand that has assurance purchased with no ace involvement will only include the return of purchased amount. However if there is a winning hand with an assurance purchased and an ace is part of the winning hand, the odds that are paid out must include the assurance purchase as part of the wager. If the Kooti Poker hand is a loser, the player loses the assurance purchase as part of the wager, whether an ace is part of the hand or not.

In light of the above disclosure, it can be seen that the wagering card game of the present invention provides an easy to play, exciting card game that combines elements of skill, strategy, and luck. While the invention has been described as to what is currently considered to be the preferred embodiments, it is to be understood that the invention is not limited to them. To the contrary, the invention is intended to cover various modifications and equivalent arrangements within the scope of the appended claims. The scope of the following claims is to be accorded the broadest interpretation so as to encompass all such modifications of equivalent structures and functions.

What is claimed is:

1. A method of playing a card game with a standard deck of playing cards, comprising the steps of:

dealing a player two cards face up;

determining whether the two dealt cards include an ace, which causes the player to automatically lose;

determining whether the two dealt cards constitute a pair, which causes the player to automatically lose;

giving the player an option to receive either one hit card or two hit cards to form a hand, with the one hit card option having as its goal to get a hit card numerically between the values of the dealt cards and the two hit card option having as its goal to get one hit card having a numerical value below that of the dealt cards and one hit card having a numerical value above that of the dealt cards;

determining whether the player received an ace as a hit card, which causes the player to automatically lose; and determining whether the player received one hit card numerically between the values of the dealt cards or whether the player received two hit cards with one having a numerical value below that of the dealt cards and one having a numerical value above that of the dealt cards, in which cases the player would have a winning hand.

2. The method of claim 1 further comprising the step of determining whether the player can form a straight, a flush, or a straight flush from the hand, in which case the player would have a winning hand.

3. The method of claim 2 further comprising the step of having the player place an ante wager before being dealt the two cards face up.

4. The method of claim 3 further comprising the step of having the player place another wager before exercising the option of receiving either one hit card or two hit cards.

5. The method of claim 4 further comprising the step of giving the player an option to buy single assurance against receiving an ace as a hit card when making his wager.

6. The method of claim 4 further comprising the step of giving the player an option to buy double assurance against receiving two aces as hit cards when making his wager.

7. A method of playing a card game with a standard deck of playing cards, comprising the steps of:

dealing a player two cards face up;

determining whether the two dealt cards include an ace, which causes the player to automatically lose;

determining whether the two dealt cards constitute a pair, which causes the player to automatically lose;

dealing the player one hit card to form a hand;

determining whether the player received an ace as the hit card, which causes the player to automatically lose; and determining whether the hit card is numerically between the values of the dealt cards, in which case the player would have a winning hand.

8. The method of claim 7 further comprising the step of determining whether the player can form a straight, a flush, or a straight flush from the hand, in which case the player would have a winning hand.

9. The method of claim 8 further comprising the step of having the player place an ante wager before being dealt the two cards face up.

10. The method of claim 9 further comprising the step of having the player place another wager before receiving the one hit card.

11. The method of claim 10 further comprising the step of giving the player an option to buy assurance against receiving an ace as the hit card when making his wager.

12. The method of claim 11 further comprising the step of dealing the player another hit card if assurance has been purchased and the hit card dealt to the player was an ace.

13. A method of playing a card game with a standard deck of playing cards, comprising the steps of:

dealing a player two cards face up;

determining whether the two dealt cards include an ace, which causes the player to automatically lose;

determining whether the two dealt cards constitute a pair, which causes the player to automatically lose;

dealing the player two hit cards to form a hand;

determining whether the player has received an ace as one or both of the hit cards, which causes the player to automatically lose; and determining whether one of the hit cards is numerically below the values of the dealt cards and the other hit card is numerically above the values of the dealt cards, in which case the player would have a winning hand.

14. The method of claim 13 further comprising the step of determining whether the player can form a straight, a flush, or a straight flush from the hand, in which case the player would have a winning hand.

15. The method of claim 14 further comprising the step of having the player place an ante wager before being dealt the two cards face up.

16. The method of claim 15 further comprising the step of having the player place another wager before receiving the two hit cards.

17. The method of claim 16 further comprising the step of giving the player an option to buy assurance against receiving an ace as one of the hit cards when making his wager.

18. The method of claim 16 further comprising the step of giving the player an option to buy double assurance against receiving two aces as hit cards when making his wager.

19. The method of claim 17 further comprising the step of allowing the player to use an ace dealt as a hit card as the lower numerically valued hit card if assurance has been purchased.

20. The method of claim 18 further comprising the step of allowing the player to use an ace dealt as a hit card as the lower or higher numerically valued hit card if double assurance has been purchased.

21. The method of claim 18 further comprising the step of allowing the player to use two aces dealt as hit cards as the lower and higher numerically valued hit cards if double assurance has been purchased, which is an automatic winning hand for the player.

* * * * *